United States Patent [19]

Takeda et al.

[11] Patent Number: 4,710,015

[45] Date of Patent: Dec. 1, 1987

[54] DEVELOPING APPARATUS

[75] Inventors: Fuchio Takeda, Tokyo; Hiroyuki Matsushiro, Yokohama; Kazuo Kobayashi, Kawasaki; Toshio Kaneko, Tokyo, all of Japan

[73] Assignee: Ricoh Company, Ltd., Tokyo, Japan

[21] Appl. No.: 923,904

[22] Filed: Oct. 28, 1986

[30] Foreign Application Priority Data

Oct. 28, 1985 [JP] Japan ..... 60-239598
Oct. 28, 1985 [JP] Japan ..... 60-239599

[51] Int. Cl.[4] ..... G03G 15/08
[52] U.S. Cl. ..... 355/3 DD; 118/651; 118/661; 29/132
[58] Field of Search ..... 355/14 D, 3 DD; 118/651, 661; 29/110, 132

[56] References Cited

U.S. PATENT DOCUMENTS

| | | | |
|---|---|---|---|
| 3,993,023 | 11/1976 | Stansell | 118/661 |
| 3,993,024 | 11/1976 | Stansell | 118/661 |
| 4,425,382 | 1/1984 | Tajima | 355/3 DD X |
| 4,505,573 | 3/1985 | Brewington et al. | 29/132 X |
| 4,593,480 | 6/1986 | Mair et al. | 29/132 X |

*Primary Examiner*—Patrick R. Salce
*Assistant Examiner*—Emanuel Todd Voeitz
*Attorney, Agent, or Firm*—Oblon, Fisher, Spivak, McClelland, & Maier

[57] ABSTRACT

A developing apparatus is disclosed, in which a developing roller composed of an insulating layer, a dielectric layer and an electrically conductive substrate is made in contact with a photosensitive member to develope a latent image on the member. The dielectric layer is formed of a material whose resistivity-specific dielectricity characteristics satisfies a certain condition which is suitable for medial tone development or binary tone development.

2 Claims, 4 Drawing Figures

DEVELOPING APPARATUS

FIELD OF THE INVENTION

The present invention relates to the so-called contact type developing apparatus and, particularly, to such apparatus capable of developing an image having medial tone or a binary image. The developing apparatus of the present invention can be applied to an electrostatic recording apparatus such as a copying machine, a facsimile apparatus and a printer etc.

RELATED ART STATEMENT

In a contact type developing apparatus, it is usual to form a thin layer of toner on a toner carrier such as developing rollers and make the toner carrier in contact with a latent image carrier such as a photosensitive member through the toner thin layer to thereby develope a latent image on the latent image carrier. In this case, in order to assure a suitable contact pressure between the toner carrier and the latent image carrier, the toner carrier is made from a resilient material, usually.

Further, in order to prevent a charge injection from the toner carrier to the latent image during the development thereof, a surface of the toner carrier which becomes in contact with the latent image carrier is coated with an insulating layer. In order to apply a biasing voltage to the toner carrier, an electrically conductive substrate is provided on an inside surface of the insulating layer as well as the resilient member.

When it is desired to develope a medial tone such as skin color or paper color on which an image is provided satisfactorily, the so-called development $\gamma$ (gamma) should be not too large and not too small and the amount of saturation toner adhesion should be large to some extent.

On the other hand, in the so-called binary development in which such medial tone is out of consideration, the gamma value as well as the amount of saturation toner adhesion should be large enough.

The development $\gamma$ means, here, a change rate of an amount of toner attracted to the latent image carrier with respect to a change of an electric field strength between the toner carrier and the latent image carrier, and the amount of toner saturation adhesion means a maximum amount of toner to be adhered to the latent image carrier.

It has been usual in manufacturing a developing apparatus that a developing characteristics thereof is not regulated by taking the nature of, particularly, the toner carrier. Therefore, a developing operation has been performed thereby without knowing whether or not the toner used is optimum in condition under which a medial tone or binary tone is appropriately developed.

SUMMARY OF THE INVENTION

The present inventors had conducted various experiments on the relation between the toner carrier and the developing characteristics of the developing apparatus and found that the developing characteristics of the developing apparatus depends largely upon the resilient member constituting the toner carrier and, in this case, the resilient member serves as a dielectric layer. It has been further found that, when a relation between a resistivity of the dielectric layer and a specific dielectricity thereof satisfies a certain constant condition, the developing $\gamma$ value becomes suitable for the medial tone development, i.e., the value is not too large and not too small, and that the amount of saturation toner adhesion increases to some extent. Particularly, when the relation satisfies the following condition, $$0.15x+5.5<\log_{10}y<0.15x+8(x>1)$$

the developing characteristics becoems optimum for the medial tone, where y is resistivity of the dielectric layer and x is specific dielectricity thereof.

On the other hand, when the relation between the resistivity and the specific dielectricity of the dielectric layer satisfies another condition, the developing $\gamma$ value and the amount of the saturation toner adhesion become large enough to develope the binary image. Particularly, when the relation satisfies the following condition, the developing characteristics becomes optimum for the binary development, $$\log_{10}y<0.15x+7.5(x>1)$$

The present invention was made in view of the above mentioned facts and a primary object thereof is to provide a toner carrier to be used in a developing apparatus of the contact type, which is suitable to develope the medial tone. Another object of the present invention is to provide a toner carrier to be used in the same apparatus, which is suitable to develope the binary image.

The primary object of the invention can be achieved by a developing apparatus including a toner carrier, in which the toner carrier has a thin toner layer formed thereon through which the toner carrier contacts with a latent image carrier of the apparatus, the toner being constituted with an electrically conductive substrate, a resilient dielectric layer formed on the substrate and an insulating layer formed on the dielectric layer and satisfying a condition of $$0.15x+5.5<\log_{10}y<0.15x+8\ (x>1)$$

where y is resistivity of the dielectric layer and x is specific dielectricity of the dielectric layer.

The second object of the present invention can be achieved by the resilient dielectric layer satisfying the following condition $$\log_{10}y<0.15x+7.5\ (x>1)$$

DETAILED DESCRIPTION OF THE PREFERRED EMBODIMENTS

Figure 1:
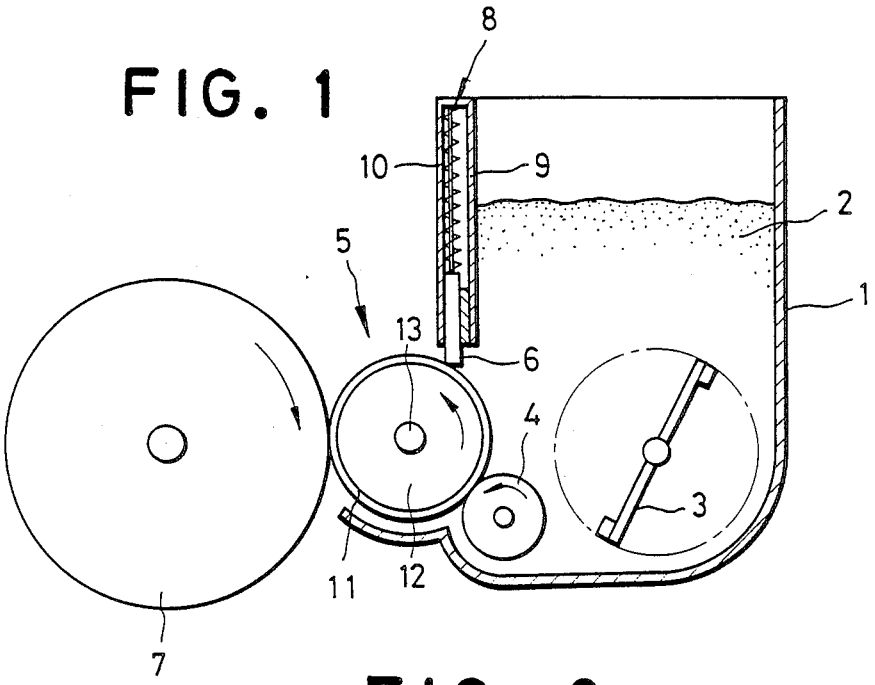
FIG. 1 is a cross sectional view of a developing apparatus according to an embodiment of the present invention.

FIG. 1 is a cross section of an embodiment of the present invention. A construction and operation of a developing apparatus will be described briefly with reference to this figure.

Toner 2 (either magnetic or non-magnetic) in a toner hopper 1 is transported by an agitator 3 to a toner supply member 4. The toner supply member 4 is a roller of, for example, polyuretane. The toner transported to the toner supply member 4 is moved with a counterclockwise rotation of the member 4, charged due to friction with a toner carrier 5 in the form of roller and adhered to a surface of the toner carrier 5 by electrostatic attraction force produced thereby.

The toner adhered to the toner carrier 5 is moved along with a counterclockwise rotation thereof to form a toner layer thereon with a thickness being regulated uniformly to a value corresponding 1 to 2 particles each having particle size of 10 $\mu$m by a toner layer control member 6, while further charged by friction with the latter member. The toner layer thus formed becomes in contact with an electrostatic latent image formed on a photosensitive member 7 in the form of drum serving as a latent image carrier to develope it. An excess portion of toner which does not attribute the development is returned to the toner supply member 4. This operation is repeated to produce a plurality of copies.

Since the formation of the electric latent image on the photosensitive member 7 is well known as the electronic photographing process, a detailed description thereof is redundant.

The apparatus further includes a pressure mechanism 8 for pressurizing the toner layer control member 6, a sealing member 9 and a support member 10 for supporting the toner layer control member 6.

As shown, the toner carrier 5 is composed of an electrically conductive substrate 13, a dielectric layer 12 formed thereon and an insulating layer 11 formed on the dielectric layer 12. The substrate 13 is supported rotatably by a frame of the developing apparatus and connected to a power source for a biasing voltage application. The substrate 13 is isolated electrically from the frame. In a case of a medial tone development, a material forming the dielectric layer 12 should satisfy the following condition $$0.15x+5.5<\log_{10}y<0.15x+8 \ (x>1)$$

where x is specific dielectricity of the material and y is resistivity thereof.

Figure 2:
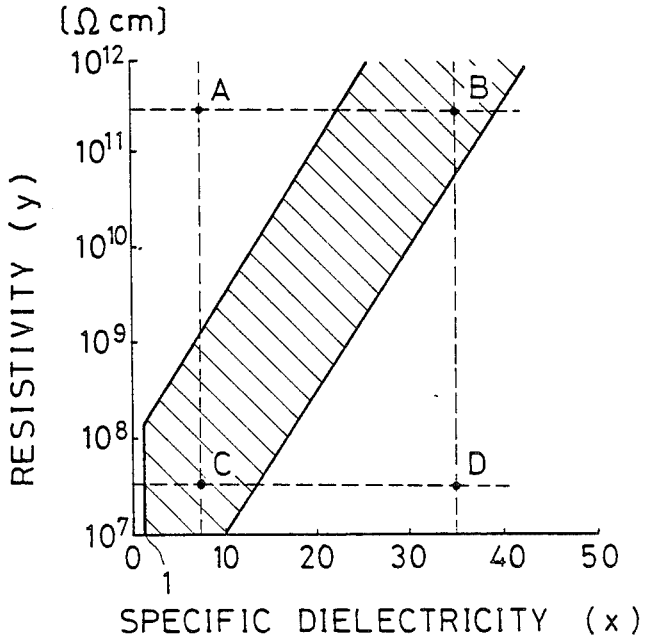
FIG. 2 is a graph showing a relation between resistivity and specific dielectricity of a dielectric layer on a toner carrier suitable to use for a development of medial tone.

FIG. 2 shows graphically the above condition, in which an area hatched satisfies the above condition. Materials fallen to the hatched area may include nitryl rubber and uretane rubber etc.

In a case where a binary development should be performed, a material forming the dielectric layer 12 should satisfy the following condition.

$$\log_{10}y<0.15x+7.5 \ (x>1)$$

Figure 4:
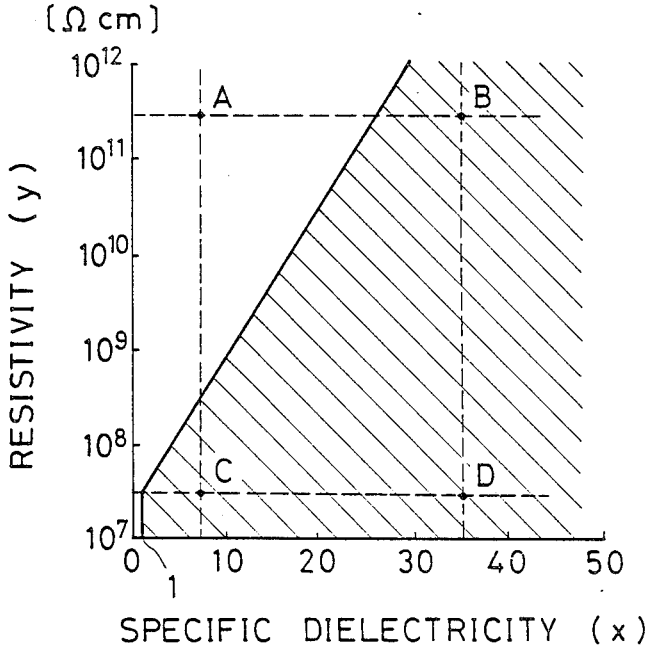
FIG. 4 is a graph showing a resistivity-specific dielectricity characteristics of a dielectric layer suitable to use in a development of binary tone.

This is shown in FIG. 4, in which a hatched area satisfies the above condition. Materials fallen in this hatched area may include nitryl rubber, uretane rubber and silicone rubber dispersed with metal particles such as Cu, Ni or carbonblack (e.g. Ketjenblack; trade name) as an agent for making such rubber electrically conductive, etc.

It is preferable to form the dielectric layer 12 of a material which make the layer both dielectric and elastic. In such case, the elasticity of the dielectric layer 12 attributes to an intimate contact of the insulating layer 11 of the toner carrier with the photosensitive member 7 through the toner layer.

The insulating layer 11 may be formed of acrylic uretane, soft epoxy resin or silicone rubber, etc.

EXPERIMENT

As a material of the dielectric layer 12, silicone rubber, high nitryl rubber, low nitryl rubber and silicone rubber dispersed with carbonblack were prepared. The resistivity-specific dielectricity characteristics of these materials are shown in FIGS. 2 and 4 by letters A, B, C and D, respectively. The materials shown by B and C are fallen in the hatched areas in FIGS. 2 and 4 and the material shown by A is out of either of the hatched areas in these figures. The material D is fallen in the hatched area in FIG. 4, while it is out of the area in FIG. 2.

As a material of the insulating layer 11, acrylic uretane was used and the toner layer control member was formed of silicone resin. Toner used was one which can be charged positively.

Figure 3:
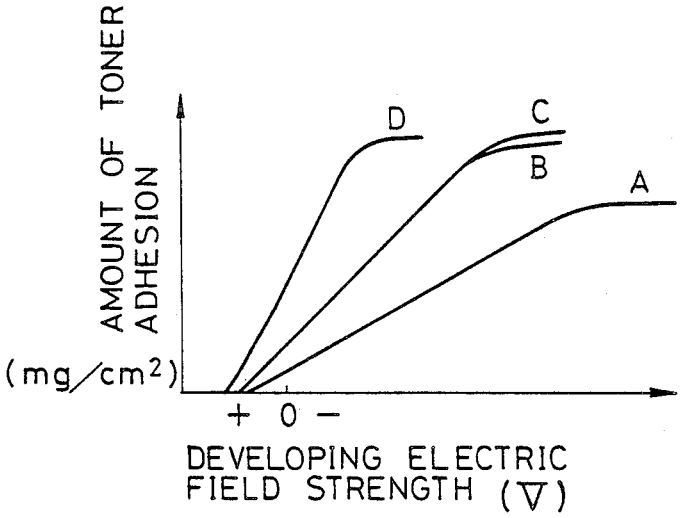
FIG. 3 is a graph showing a variation of the amount of toner adhered to a copy paper resulting from various dielectric layers.

The developing apparatus was constituted with those members formed of the materials mentioned above, respectively, and was operated usually. A charge amount of toner measured was $+15$ $\mu$c/g. A relation of electric field strength between the toner carrier 5 and the photosensitive member 7 to amount of toner adhered to the photosensitive member 7 was observed, a result being shown in FIG. 3. In FIG. 3, letters A, B, C and D correspond to those obtained for silicone rubber, high nitryl rubber, low nitryl rubber and silicone rubber dispersed with carbonblack as the dielectric material of the dielectric layer 12, respectively. As is clear from FIG. 3, curves B and C provide moderate developing $\gamma$ value (corresponds to a tilting of straight portion of the curve) and a large amount of toner adhesion to the photosensitive member. Therefore, these are preferable for medial tone development. On the other hand, a curve A provides the developing $\gamma$ value and the saturation toner adhesion which are too small and a curve D shows them which are too large. Therefore, the materials which have properties shown by the curves A and D are not suitable for the medial tone development.

On the other hand, the materials shown by the curves B, C and D have necessary developing $\gamma$ value and the saturation toner adhesion while that shown by the curve A does not. Therefore, the materials B, C, and D may be suitable for the binary tone development.

What is claimed is:

1. A developing apparatus of the type in which a thin toner layer is formed on a toner carrier such that said toner carrier is in contact with a latent image carrier through said toner layer to devlope a latent image on said latent image carrier, characterized by that said toner carrier is composed of an electrically conductive substrate an elastic dielectric layer formed on said substrate and supported thereby and an insulating layer formed on said elastic dielectric layer and that said elastic dielectric layer is formed of a material which satisfies $$\log_{10}y<0.15x+7.5 \ (x>1)$$

where x is specific dielectricity of said material and y is resistivity of said material.

2. A developing apparatus of the type in which a thin toner layer is formed on a toner carrier such that said toner carrier is in contact with a latent image carrier through said thin toner layer to develope a latent image on said latent image carrier, characterized by that said toner carrier is composed of an electrically conductive substrate, an elastic dielectric layer formed on said substrate and supported thereby and an insulating layer formed on said elastic dielectric layer and that said elastic dielectric layer is formed of a material which satisfies $$0.15x+5.5<\log_{10}y<0.15x+8 \ (x>1)$$

where x is specific dielectricity of said material and y is resistivity of said material.

* * * * *